US006102759A

United States Patent [19]

Klimenko

[11] Patent Number: 6,102,759

[45] Date of Patent: Aug. 15, 2000

[54] INFLATABLE RAFT WITH ACCORDION CONTAINER

[75] Inventor: K. Conny Klimenko, Los Angeles, Calif.

[73] Assignee: Sevylor U.S.A., Inc., Los Angeles, Calif.

[21] Appl. No.: 09/037,986

[22] Filed: Mar. 11, 1998

[51] Int. Cl.[7] ..... B63B 35/58

[52] U.S. Cl. ..... 441/40; 441/129

[58] Field of Search ..... 441/109, 110, 441/40, 35, 129, 130, 136; 114/348, 345

[56] References Cited

U.S. PATENT DOCUMENTS

| | | | |
|---|---|---|---|
| D. 378,169 | 2/1997 | Yu . | |
| 3,831,209 | 8/1974 | Clingman | 9/1 |
| 4,907,997 | 3/1990 | Hall | 114/345 |
| 5,162,007 | 11/1992 | Leslie | 441/129 |
| 5,163,694 | 11/1992 | Reichek | 280/47.26 |
| 5,233,705 | 8/1993 | Coleman et al. | 4/496 |
| 5,403,220 | 4/1995 | Goad, Sr. | 441/130 |
| 5,518,431 | 5/1996 | Staley | 441/130 |
| 5,729,840 | 3/1998 | Wu | 4/588 |

FOREIGN PATENT DOCUMENTS

| | | | |
|---|---|---|---|
| 1062102 | 8/1982 | U.S.S.R. | 7/8 |

*Primary Examiner*—Stephen Avila
*Attorney, Agent, or Firm*—Dean W. Russell; Kilpatrick Stockton LLP

[57] ABSTRACT

Disclosed is an inflatable raft having an opening formed on one of its four side portions. A downward and then radially inward extended frame is formed around the opening for a top flange of a container to be radio heated thereto. The container has an accordion body. When the raft is inflated, the accordion container can be downward stretched to accommodate a can therein. And, when the raft is deflated, the accordion container can be collapsed along with the raft for convenient storage. The structure of the inflatable raft will not be adversely affected by the provision of the accordion container on the raft.

16 Claims, 4 Drawing Sheets

INFLATABLE RAFT WITH ACCORDION CONTAINER

BACKGROUND OF THE INVENTION

People nowadays pay more and more attention to their leisure activities and a large part of these people enjoy water activities very much. An inflatable raft is a very popular means for offshore activities. When people lying on rafts take the sun, they tend to become thirsty and might need some drinks. At this point, they have to return to the beach from a position off shore that might be very far away from the beach to get some drinks and then return to the rafts again. It is, of course, time and labor consuming for people to walk between the beach and sea just for a can of drink. It is therefore tried by the inventor to develop an inflatable raft which is provided with a container to hold drinks, so that people may enjoy drinks directly on the raft over sea.

SUMMARY OF THE INVENTION

It is therefore a primary object of the present invention to provide an inflatable raft with accordion container. To achieve the above object, an opening is formed on one of four side portions of the raft. A downward and then radially inward extended frame is formed around the opening for a top flange of a container to overlap and be radio heated thereto. The container has an accordion body. When the raft is inflated, the accordion container can be downward stretched to conceal below the side portion and to accommodate a can therein. And, when the raft is deflated, the accordion container can be collapsed along with the raft for convenient storage. The structure of the inflatable raft will not be adversely affected by the provision of the accordion container on the raft.

DETAILED DESCRIPTION OF THE PREFERRED EMBODIMENTS

Figure 1:
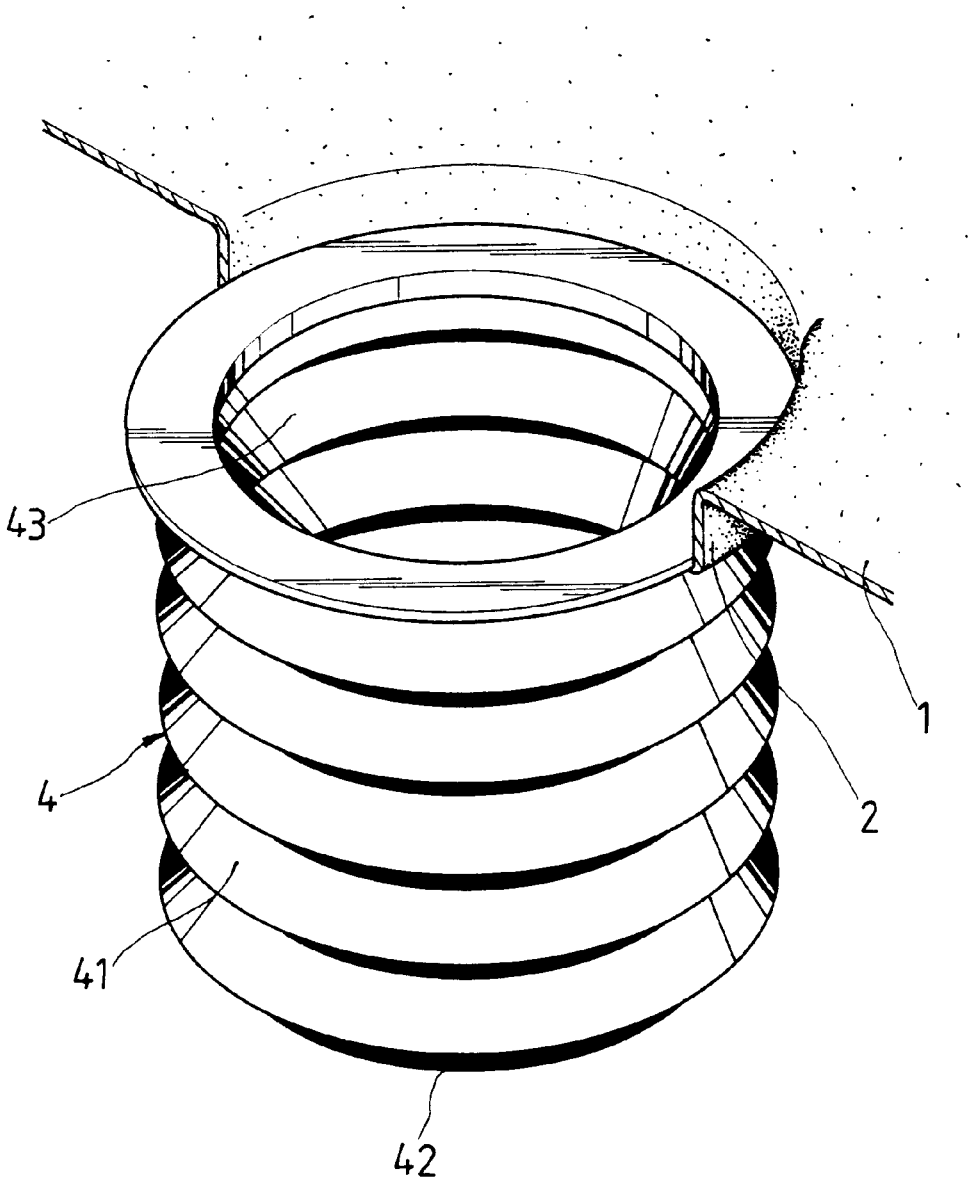
FIG. 1 is a fragmentary perspective showing an accordion container connected to an inflatable raft according to the present invention, a part of which being cut away to better show the joint between the accordion container and the inflatable raft.

Please refer to FIGS. 1 to 4 at the same time. The present invention relates to an inflatable raft 3 having four side portions 1. An opening is formed on one of the side portions 1 at a suitable position with a periphery of the opening extending downward and then radially inward to form a frame 2 of the opening. The frame 2 is made of the same material as that for the inflatable raft 3, and is preferably an integral part of the inflatable raft 3. A container 4 also made of the same material as that for the inflatable raft 3 is so formed that its body includes a plurality of circumferentially extended accordion pleats 41. The container 4 has a bottom 42 sealed to a lowest accordion pleat 41 of the container 4, so that a space 43 is enclosed by the bottom 42 and the accordion pleats 41. When the accordion pleats 41 are in their fully stretched state, the space 43 has height and width slightly larger than that of an aluminum can 5 for soft drink. The container 4 has a radially outward extended top flange 44 which is designed to connect to the frame 2 of the opening on the inflatable raft 3 by radio heating, so that the container 4 becomes an integral part of the side portion 1 of the inflatable raft 3.

Figure 2:
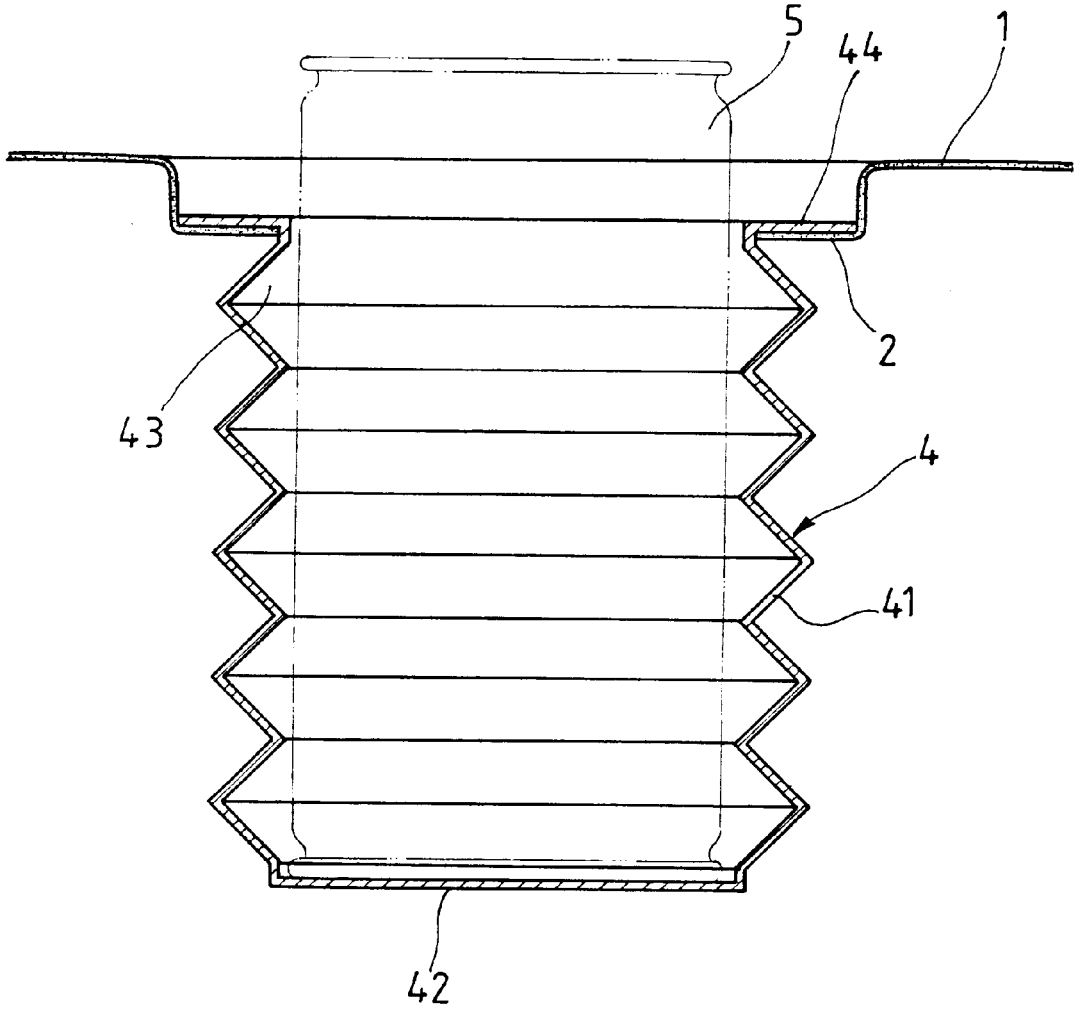
FIG. 2 is a fragmentary, vertical sectional view of FIG. 1 with a can of drink disposed in the accordion container.

When the inflatable raft 3 is fully inflated, a distance between top and bottom surfaces of the side portions 1 increases, allowing the accordion pleats 41 of the container 4 to conceal below a top surface of the side portion 1 at where the container 4 is provided, as shown in FIG. 2. When a can 5 is put into the container 4, the accordion pleats 41 automatically stretch due to the gravity and the weight of the can 5.

Figure 3:
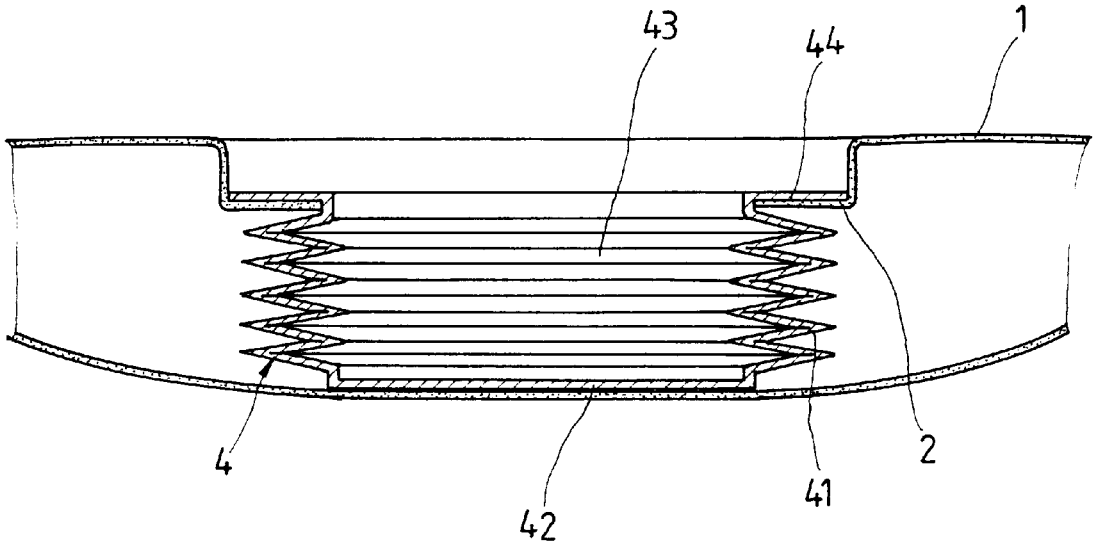
FIG. 3 is a fragmentary, vertical sectional view showing the accordion container in a collapsed state when the raft is deflated.
Figure 4:
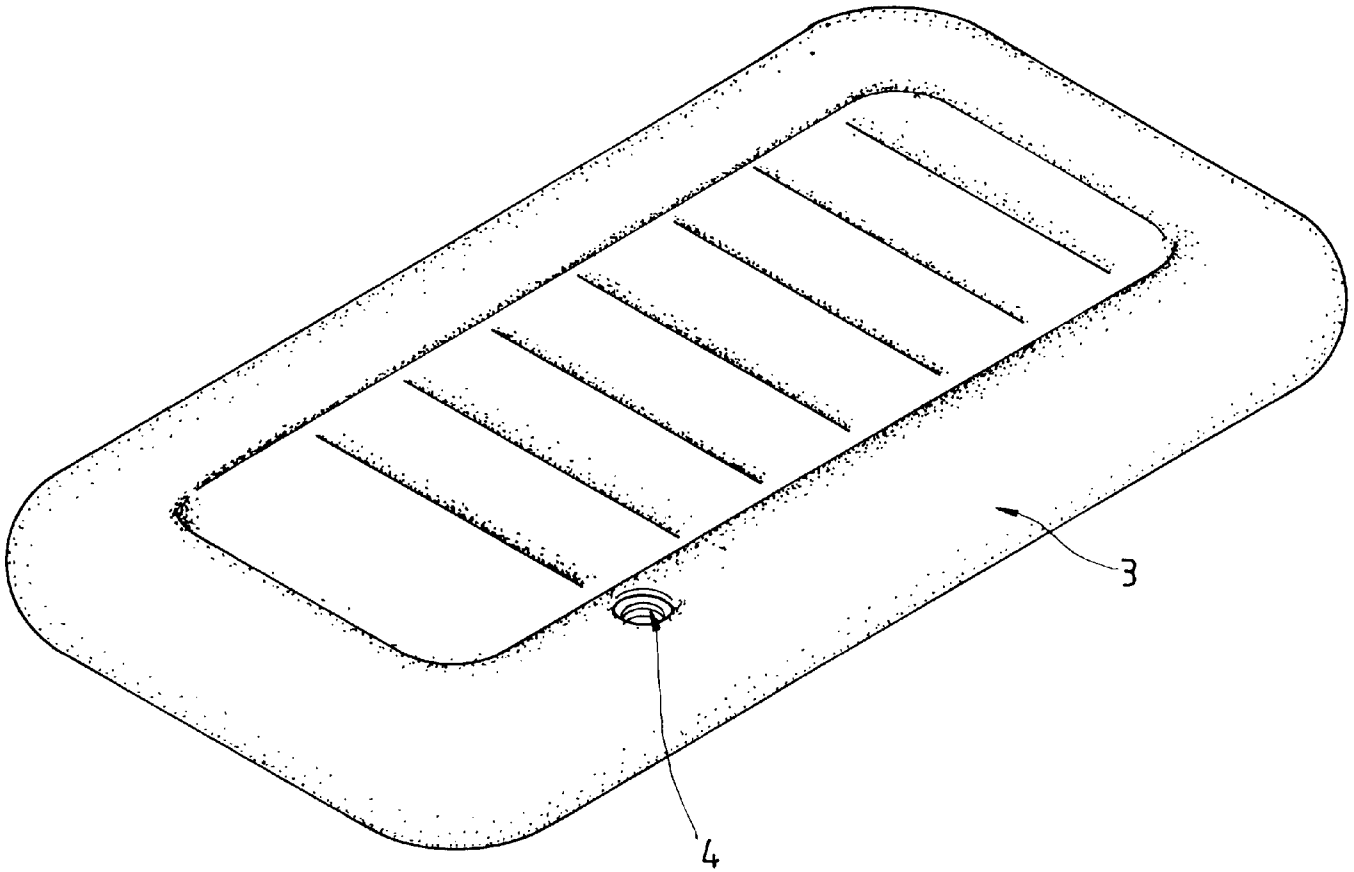
FIG. 4 is a perspective showing an inflatable raft with an accordion container provided at one side of the raft.

When the can 5 is removed from the container 4 and the raft 3 is deflated, the accordion pleats 41 are flattened and can be folded along with the deflated raft 3, as shown in FIG. 3. The provision of the frame 2 and the accordion container 4 on the inflatable raft 3 will, therefore, not affect the structure of the raft at all.

What is claimed is:

1. An inflatable raft, comprising:

a. a body defining an inflatable interior region and a frame; and b. a container:

i. extending into the interior region of the body;

ii. collapsible into a first position when the raft is not inflated;

iii. capable of being expanded into a second position extending into the interior region when the raft is inflated, such that when expanded into the second position, the container is capable of receiving and supporting a beverage can; and iv. comprising:

A. a top flange connected to the frame using radio heating;

B. a plurality of accordion pleats; and

C. a bottom sealed to the accordion pleat most remote from the top flange.

2. An inflatable object which in use supports a person in a reclining or sitting position, comprising:

a. a body defining an inflatable interior region; and b. a separate uninflatable beverage-vessel container (i) comprising a plurality of accordion pleats, (ii) connected to the body, and (iii) extending into the interior region thereof, the container collapsible into a first position when the object is not inflated and capable of being expanded into a second position extending into the interior region when the object is inflated, such that when expanded into the second position, the container is capable of receiving and supporting a beverage vessel.

3. An inflatable object which in use supports a person in a reclining or sitting position, comprising:

a. a body defining an interior region inflatable with inflation fluid in use; and b. a container connected to the body and extending into the interior region thereof where the inflation fluid is present in use, the container being corrugated and capable of receiving and supporting an article.

4. An inflatable object according to claim 3 in which the corrugated container comprises a top flange connected to the body.

5. An inflatable object according to claim 3 in which the corrugated container comprises:

a. a plurality of accordion pleats; and b. a bottom sealed to one of the accordion pleats.

6. An inflatable object according to claim 3 in which the article is a beverage can.

7. An inflatable object according to claim 6 in which the object is a raft and the container is generally cylindrical.

8. An inflatable object according to claim 3 in which the container has sufficient rigidity for the corrugations to be present regardless of whether the interior region of the body is inflated or deflated.

9. An inflatable object according to claim 5 in which the container is collapsible into a first position when the object is not inflated and capable of being expanded into a second position extending into the interior region when the object is inflated, such that when expanded into the second position the container is capable of receiving and supporting an article.

10. An inflatable object according to claim 9 in which the body further defines a frame to which the container is connected so as to become an integral part of the body.

11. An inflatable object according to claim 10 in which the container is connected to the frame using radio heating.

12. An inflatable object according to claim 11 in which the container further comprises a top flange connected to the frame.

13. An inflatable object which in use supports a person in a reclining or sitting position, comprising:

a. a body defining an interior region inflatable with inflation fluid in use; and b. a container connected to the body and extending into the interior region thereof where the inflation fluid is present in use, the container comprising a plurality of accordion pleats and capable of receiving and supporting an article.

14. An inflatable object which in use supports a person in a reclining or sitting position, comprising:

a. a body defining an interior region inflatable with inflation fluid in use;

b. a frame connected to the body and extending into the interior region thereof where the inflation fluid is present in use; and c. a container (i) contacting the frame, (ii) comprising a side wall, and (iii) in which a beverage cup or can may be placed.

15. An inflatable object according to claim 14 in which the container comprises a flange defining a mouth and connected to the frame.

16. An inflatable object according to claim 14 in which the container further comprises a bottom sealed to the side wall.

* * * * *